US005797925A

United States Patent [19]

Heintke

[11] Patent Number: 5,797,925

[45] Date of Patent: Aug. 25, 1998

[54] DEPILATING DEVICE WITH A MULTIPLE-SHELL HOUSING

[75] Inventor: Hans-Eberhardt Heintke, Wächtersbach, Germany

[73] Assignee: Braun Aktiengesellschaft, Frankfurt, Germany

[21] Appl. No.: 619,656

[22] PCT Filed: Jul. 13, 1995

[86] PCT No.: PCT/EP95/02739

§ 371 Date: Mar. 21, 1996

§ 102(e) Date: Mar. 21, 1996

[87] PCT Pub. No.: WO96/05751

PCT Pub. Date: Feb. 29, 1996

[30] Foreign Application Priority Data

Aug. 18, 1994 [DE] Germany ..... 44 28 892.1

[51] Int. Cl.[6] ..... A61D 1/06

[52] U.S. Cl. ..... 606/133; 606/131

[58] Field of Search ..... 606/131, 133, 606/135, 134, 36, 43

[56] References Cited

U.S. PATENT DOCUMENTS

| | | | |
|---|---|---|---|
| 3,458,737 | 7/1969 | Lookman . | |
| 4,960,422 | 10/1990 | Demeester | 606/135 |
| 5,100,414 | 3/1992 | Dolev | 606/131 |
| 5,112,341 | 5/1992 | Doley | 606/131 |
| 5,190,559 | 3/1993 | Gabion et al. | 606/131 |
| 5,197,969 | 3/1993 | Visscher et al. | 606/133 |
| 5,356,415 | 10/1994 | Iwasaki et al. | 606/131 |
| 5,494,485 | 2/1996 | Gabion et al. | 606/133 |

FOREIGN PATENT DOCUMENTS

| | | |
|---|---|---|
| A 0 500 075 | 8/1992 | European Pat. Off. . |
| A O 532 107 | 3/1993 | European Pat. Off. . |
| A 2 014 372 | 8/1979 | United Kingdom . |

*Primary Examiner*—Robert A. Hafer
*Assistant Examiner*—Justine R. Yu
*Attorney, Agent, or Firm*—Fish & Richardson, P.C.

[57] ABSTRACT

The present invention relates to a depilating device with a multiple-shell housing (2), which a user can hold in the hand, a motor (13) accommodated in the housing (2), and a gear (14) to drive a rotary cylinder (8) which is preferably provided in a housing part (7) that is adapted to be uncoupled from the housing (2). The mechanically operated component parts, more particularly motor (13), gear (14), and rotary cylinder (8) with the housing part (8) in which it is incorporated, form an assembly unit (15) which is retained in the housing (2). Vibration absorbing elements (16, 17, 18) are provided at the points of connection between the assembly unit (15) and the housing (2).

17 Claims, 5 Drawing Sheets

DEPILATING DEVICE WITH A MULTIPLE-SHELL HOUSING

The present invention relates to a depilating device with a multiple-shell housing, which can be held in the hand, including a motor incorporated in the housing and a gear to drive a rotary cylinder, with the rotary cylinder being preferably arranged in a housing part adapted to be uncoupled from the housing.

The present invention is based on a depilating device disclosed in international publication No. WO 93/04606 for removing hair from human body skin, including a housing, which can be hand held by a user, a rotary cylinder that is driven by a motor and has pinching elements, and at least one actuating element, extending through the rotary cylinder, to actuate the pinching elements coupled to the actuating element. In this arrangement, the actuating element is operable by a pressure element associated with the actuating element and is movable in opposition to the pressure of a spring, and a means is provided to adjust the pinching force of the pinching elements. This device shows a housing having a housing bottom part and a housing top part (depilator head). A battery, a motor, and a gear to drive a rotary cylinder are rigidly mounted in the housing bottom part. The depilator head is detachably coupled to the housing bottom part for cleaning purposes.

This known depilating device as disclosed in WO 93/04606 includes a plastic housing in which the mechanical component parts such as motor, gear and rotary cylinder, in the capacity of single component parts, are directly mounted in the housing. In this arrangement, operating noises, for example, produced by the mechanically operated component parts in the device are transmitted to the housing without being absorbed. Thus, they are felt as disturbing by the user. Further, it should be noted with respect to this device that vibrations acting on the device from the outside are transmitted unabsorbed to the mechanical and electrical component parts in the housing. The result is that damage to the mounted parts caused by vibrations cannot be avoided.

An object of the present invention is to provide a depilating device which permits effectively uncoupling the noises and mechanical vibrations produced by the mounted parts from the housing of the device. Another objective is achieving a mechanical vibration absorption of the mounted parts, thereby preventing vibrations, acting on the device from the outside, from being transmitted unabsorbed to the mounted parts. Still another objective is achieving a depilating device which can be manufactured less costly with respect to the assembly and is easier to handle, for example, when cleaned by the user.

This object is achieved by the present invention in that mechanically operated component parts, especially motor, gear, and rotary cylinder including the housing part in which it is incorporated, form an assembly unit retained in the housing. Vibration absorbing elements are provided at the points of connection between the assembly unit and the housing.

It is achieved by this arrangement that the depilating device mainly comprises two assembly units, i.e., the unit of the mechanically operated parts and the housing formed of a plurality of shells. Advantageously, this permits effectively uncoupling the mechanical parts from the housing. The noises produced in the housing are reduced by the vibration absorbing elements provided between the assembly unit of the mechanically operated component parts and the housing.

In a preferred embodiment of the assembly unit including the mechanically operated component parts, the motor and the gear are rigidly interconnected. A drive unit is provided thereby which, favourably, can be fitted easily into a housing shell. The so preassembled motor-and-gear unit permits a major simplification of the housing assembly.

In another embodiment of the present invention, the housing part accommodating the rotary cylinder is detachably coupled to the gear. To this end, the rotary cylinder can be preassembled in an open carrier member or in a closed housing. This housing part is connected to the gear, or to a carrier element or housing accommodating the gear. Advantageously, the assembly unit including motor and gear is initially mounted in a housing shell, and, subsequently, the housing part with the rotary cylinder is slipped onto the gear, locked into the gear or mechanically coupled to it in a similar manner.

In a favourable embodiment of the present invention, points of support and mating retaining means such as webs, pins, projections or similar elements are provided. The points of support may be provided on the assembly unit and the retaining means on the housing, or vice-versa, or there may be a mixed arrangement. It is advantageously achieved thereby that, for example, retaining pins on the gear can be fitted and locked in defined points of support on the housing. This permits a simple assembly and reliable fixation of the assembly unit with the mechanical parts in the housing.

In a preferred embodiment of the present invention, the vibration absorbing elements are mounted on the motor-and-gear assembly unit. Advantageously, the vibration absorbing elements can be preassembled as rings or cap-like elements on the assembly unit.

Another embodiment of the present invention suggests mounting the vibration absorbing elements in the housing. This arrangement is a favourable alternative to the above-mentioned design, and the vibration absorbing elements can preferably be coupled rigidly to the housing and/or can be provided in a two-shell design.

Advantageously, the vibration absorbing elements are designed to absorb acoustical and/or mechanical vibrations. This permits uncoupling the noises produced in the device, on the one hand, and absorbing the mechanical vibrations produced in the device when transmitted to the housing, and/or reducing external influences which may be transmitted through the housing to the component parts in the housing, on the other hand.

In a preferred embodiment of the present invention, the vibration absorbing elements are made of rubber or any other elastic material. Favourably, rubber rings, washers, caps or other component parts which have a similarly simple design and offer low-cost manufacture are used.

According to another aspect of the present invention, the vibration absorbing elements are elastic spring elements. Advantageously, the spring elements can be made of spring steel, for example, taking the shape of tension springs, compression springs or leaf springs.

Further, a partition line is provided between the housing and the housing part accommodating the rotary cylinder according to the present invention. The partition line can extend transversely to the main axis of the housing and in parallel to the axis of rotation of the rotary cylinder, for example. Designing the partition line as a joint that circumferentially extends along the housing of the device provides a favourable separation of the depilator head, in which the rotary cylinder is accommodated, from the remaining housing of the depilating device. Due to the provision of the mechanical parts in an assembly unit, an effective uncoupling of this assembly unit from the remaining housing of the device is achieved.

It is suggested in another aspect of the present invention that the housing part, in which the rotary cylinder is incorporated, is preferably coupled to the motor-and-gear drive unit by a locking device. Expediently, this arrangement permits a simple, detachable coupling between the housing part and the gear, and the embodied arrangement is easy to manufacture and easy to handle by the user. This independent embodiment of the present invention can be used not only in the present depilating device, but also in depilating devices of any other design.

A locking device of the above-mentioned type is designed so that the housing part includes at least one locking element, and the gear housing has at least one coupling element mating with the locking element. Advantageously, this achieves reducing the number of component parts required for the locking device.

An additional suggestion involves providing at least one actuating element in the housing part to actuate a locking element. The actuating element, or preferably two actuating elements, are advantageously arranged on the outside of the housing part to act directly on the locking element(s) provided in the housing part.

In another embodiment of the present invention, the actuating element is movable in opposition to the pressure of a spring transversely to the axis of rotation of the rotary cylinder. Favourably, a compression spring is arranged in the housing part for this purpose, urging the actuating element outwardly against a stop on the housing part. Advantageously, only restricted mounting space is required in the housing part for one actuating element, or for two actuating elements, because the actuating element is arranged transversely to the axis of rotation of the rotary cylinder.

In still another embodiment of the present invention, the actuating element and the locking element in operative engagement with the actuating element are integrally designed as one component part. In this configuration, the actuating element is fitted so as to project from the outside of the housing part, while the locking element is provided in the housing part, preferably on the bottom side of the housing part.

It is preferred that the actuating elements are arranged on two opposed longitudinal sides of the housing part. Favourably, this offers ease of manipulation to the user of the device when unlocking the housing part. A symmetrical introduction of force is ensured by the two opposite actuating elements.

Further features, advantages and possible applications of the present invention will become apparent from the following description of embodiments shown in detail in the accompanying drawings. All features described and/or illustrated form per se, or in any combination desired, the subject matter of the present invention, irrespective of their combination in the claims or the appendency of the claims.

Figure 1:
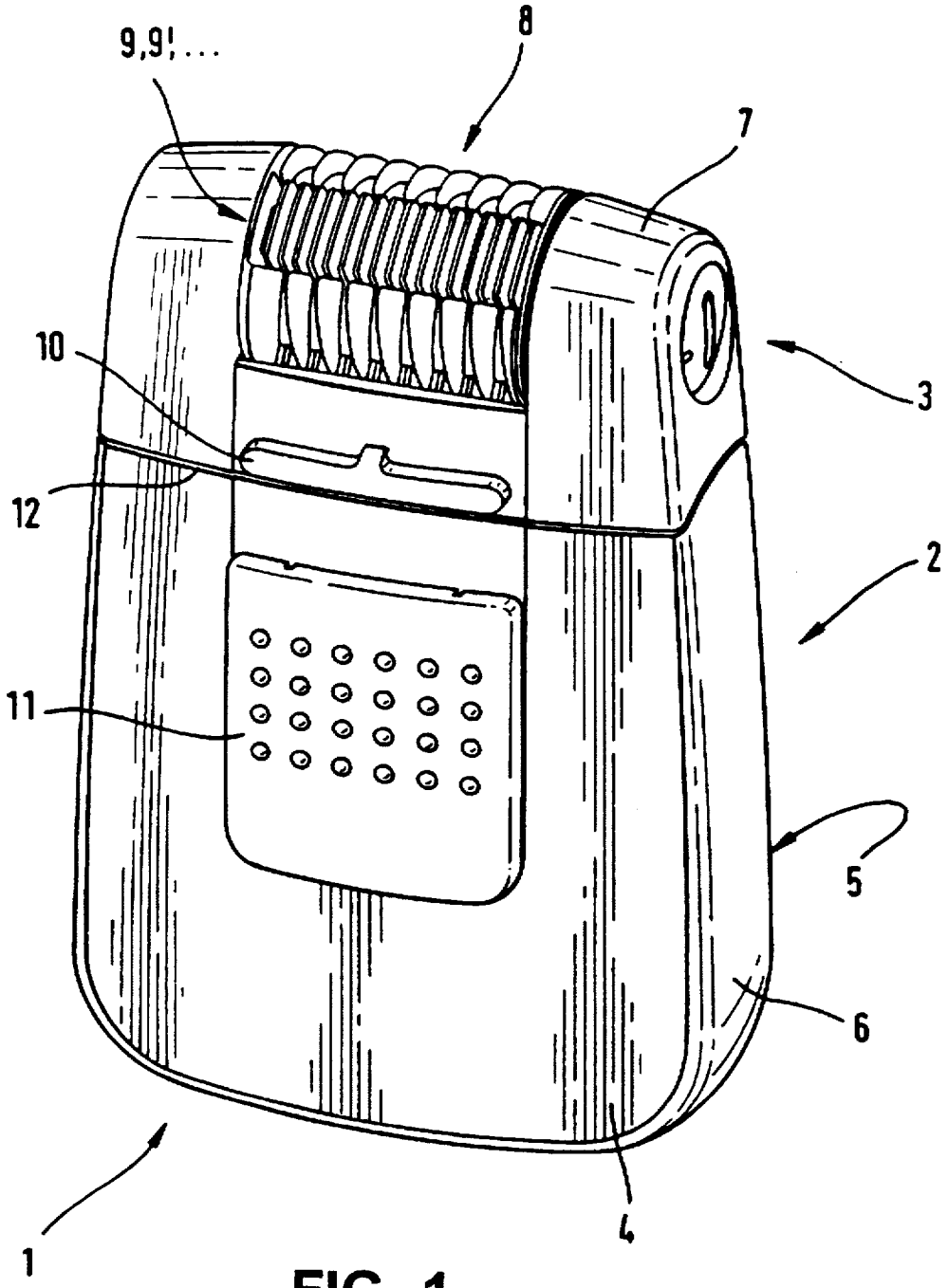
FIG. 1 is a perspective view of a depilating device according to the present invention.

A depilating device 1 in FIG. 1 comprises a multiple-shell housing, i.e., housing bottom part 2 and a depilator head 3. Housing 2 includes a housing top shell 4, a bottom shell 5 and a lateral part 6.

The depilator head 3 mainly includes a housing part 7 which accommodates a rotary cylinder 8 having pinching elements 9, 9', . . . An actuating element 10 is arranged on the front side of the housing part 7 and projects from the surface of the housing part 7. The actuating element 10 is actuated to unlock the depilator head 3. A slider switch 11, serving to adjust the respective operating condition of the device 1, is fitted to the upper shell 4 of housing 2.

The bottom part of housing 2 and the depilator head 3 are preferably made of hard plastic material and isolated from each other by a circumferential partition line 12 so that the housing 2 and the depilator head 3 are not in contact.

Figure 2:
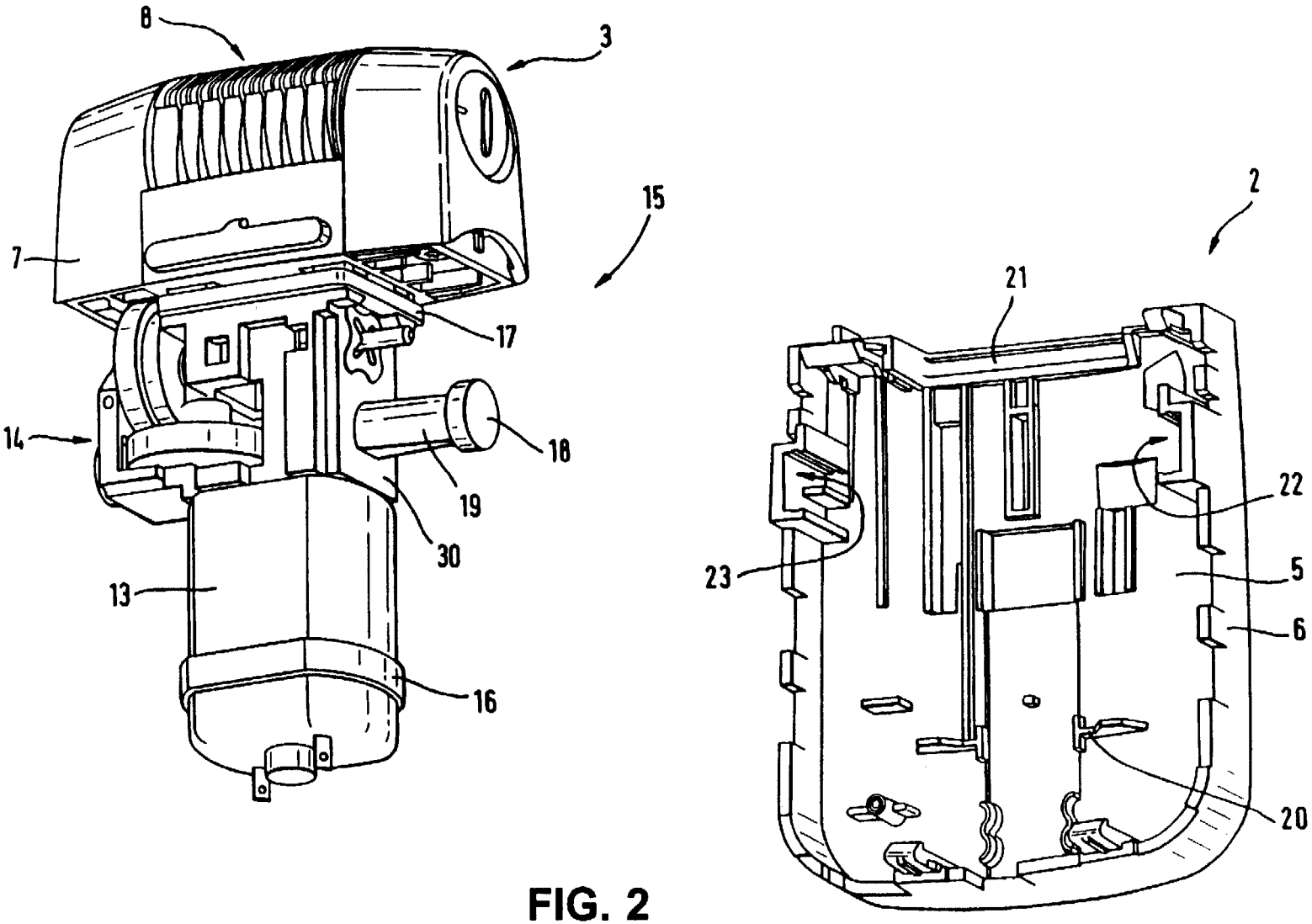
FIG. 2 is a perspective view of a depilating device including two assembly units according to the present invention, i.e., the mechanically operated component parts and a part of the housing shells.

The housing 2 in FIG. 2 mainly accommodates an electric motor 13 and a gear 14 which are coupled to the depilator head 3 and jointly form an assembly unit 15 of the mechanically operated component parts.

Vibration absorbing elements 16, 17, 18 are attached to the assembly unit 15. These elements can be annular elements 16, 17 or a cylindrical cap 18 made of an elastic rubber material, for example. The annular vibration absorbing elements 16, 17 are mounted on opposed ends of the motor 13 and the gear 14. The cylindrical vibration absorbing element 18 is slipped onto one end of a pin 19 which is connected to gear housing 30. Vibration absorbing elements can also be elastic spring elements, as shown in FIG. 3A. In place of pin 19, other mating retaining means such as a web, a projection, or other similar elements may be used.

The upper shell is removed from the housing 2 so that the inner sides of the bottom shell 5 and the lateral part 6 are visible. Points of support 20, 21 are provided in the bottom shell 5, and points of support 22, 23 are provided in the lateral part 6. The assembly unit 15 is inserted into the housing 2 so that the vibration absorbing elements 16, 17, 18 are exactly fixed in position in the respective mating points of support 20, 21, 22, 23.

According to the present invention, the depilating device is subdivided into two separate assembly units, i.e., a housing 2 and an assembly unit 15 with the mechanically operated component parts 8, 13, 14. The housing 2 is thereby uncoupled effectively from the assembly unit 15 so that all acoustical and/or mechanical vibrations produced in the device are conducted to the housing 2 in an absorbed fashion. In addition, any mechanical influences acting on the housing 2 from the outside will be absorbed before they are transmitted to the assembly unit 15.

Figure 3:
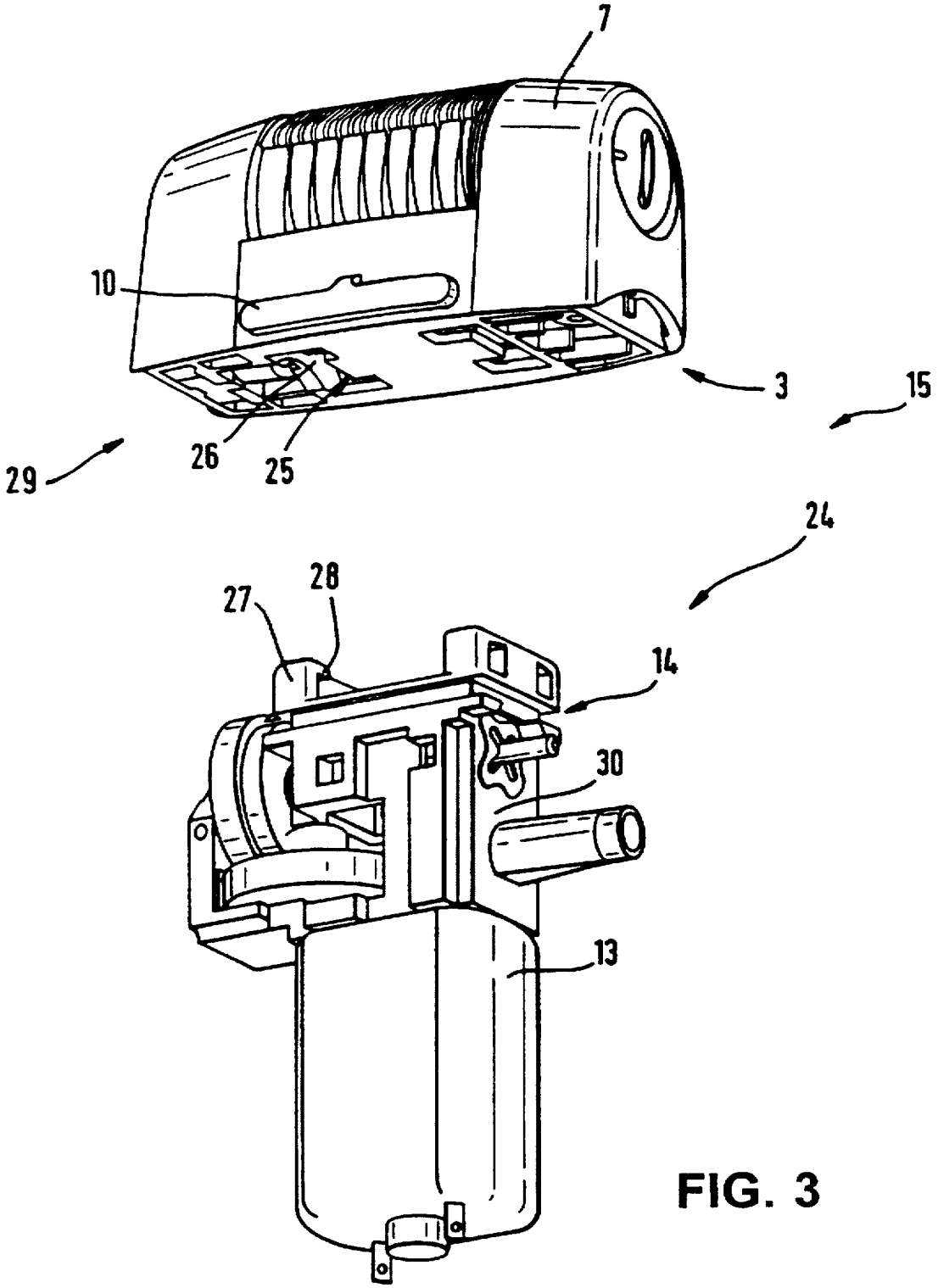
FIG. 3 is a perspective view of an assembly unit with mechanical component parts, wherein the depilator head with the rotary cylinder is removed from the driving unit.
Figure 3A:
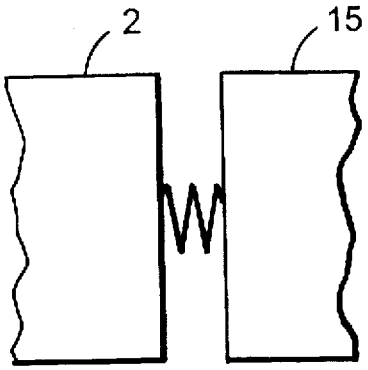
FIG. 3A shows a spring element between an assembly unit and a housing.

The assembly unit 15 in FIG. 3 can be subdivided by a locking device 29 into the depilator head 3 and a drive unit 24, comprising motor 13 and gear 14. The locking device 29 mainly includes a locking element 25, provided in a recess 26 on the bottom side of the housing part 7, and a coupling element 27, arranged on the upper side of the gear housing 30. The coupling element 27 has a nose-shaped projection 28 which can be inserted into the recess 26 and locked by the locking element 25 when the actuating element 10 is actuated.

Figure 4B:
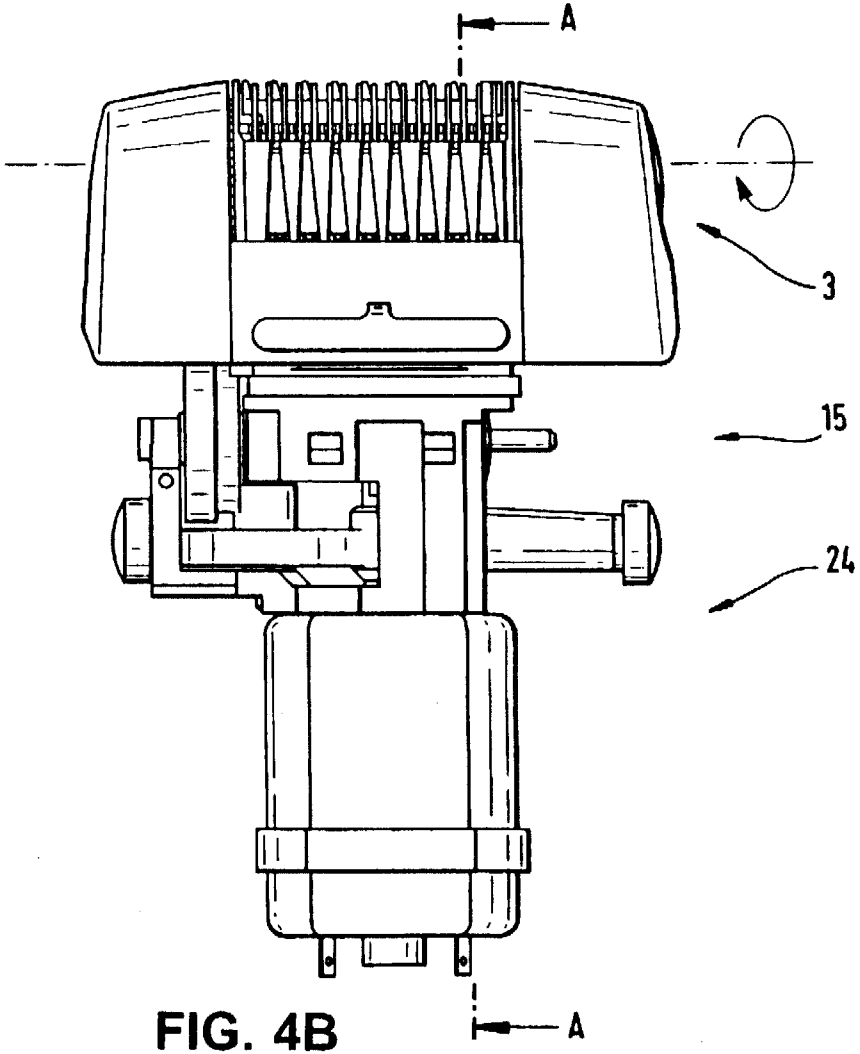
FIG. 4B is a cross-section of the assembly unit in FIG. 4A along the line A—A.
Figure 4A:
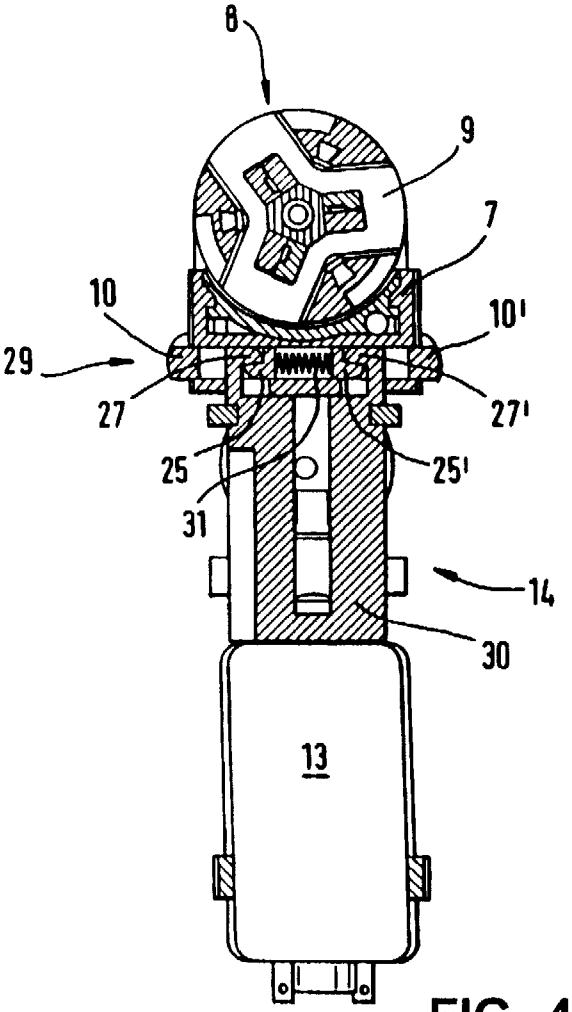
FIG. 4A is a frontal view of an assembly unit.

FIG. 4A shows the assembly unit 15 which includes the depilator head 3 and the drive unit 24. A longitudinal cross-section taken along line A—A is shown in FIG. 4B.

The gear 14 is fitted to the motor 13 and connected to the housing part 7 of the depilator head 3 by way of the locking device 29. The rotary cylinder 8 with the pinching elements 9, 9', . . . is arranged in the housing part 7.

The locking device 29 has a symmetrical design so that an actuating element 10, 10' is arranged on each of the two longitudinal sides of the housing part 7. The actuating element 10, 10' interacts with the corresponding locking elements 25, 25' and coupling elements 27, 27'.

The two coupling elements 27, 27', having their nose-shaped projections arranged towards the middle of the device, are provided on the upper side of the gear housing 30. The rigid coupling elements 27, 27' are in engagement with the movably arranged locking elements 25, 25'. The locking elements 25, 25' are designed integrally with the actuating elements 10, 10', for example. The locking elements 25, 25' are moved towards each other and detached from the coupling elements 27, 27' by lateral pressure on the actuating elements 10, 10', in opposition to the force of a compression spring 31 which is interposed between the two locking elements 25, 25'. Subsequently, the depilator head 3 can be removed vertically upwardly from the drive unit 24.

I claim:

1. A depilating device comprising, a first housing comprising a plurality of shells;

an assembly unit comprising:

(a) a rotary cylinder;

(b) a motor;

(c) a gear assembly, wherein the gear assembly and the motor drive the rotary cylinder; and (d) a second housing incorporating the rotary cylinder, the second housing being detachably coupled to the gear assembly; and vibration absorbing elements;

wherein the assembly unit is supported in and isolated from the first housing by the vibration absorbing elements, and wherein the vibration abosrbing elements are located at points of connection between the assembly unit and the first housing.

2. A depilating device as claimed in claim 1, wherein the motor and the gear assembly are rigidly interconnected.

3. A depilating device as claimed in claim 1, wherein at least one of the assembly unit and the first housing further comprises at least one of a point of support and retaining means for mating with a point of support.

4. A depilating device as claimed in claim 1, wherein the vibration absorbing elements are mounted on the assembly unit.

5. A depilating device as claimed in claim 1, wherein the vibration absorbing elements are mounted in the first housing.

6. A depilating device as claimed in claim 1, wherein the vibration absorbing elements are designed to absorb at least one of acoustical and mechanical vibrations.

7. A depilating device as claimed in claim 1, wherein the vibration absorbing elements are made of elastic material.

8. A depilating device as claimed in claim 1, wherein the vibration absorbing elements are elastic spring elements.

9. A depilating device as claimed in claim 1, further comprising a partition line between the first housing and the second housing.

10. A depilating device as claimed in claim 1, wherein the assembly unit comprises a locking device and the second housing is detachably coupled to the gear assembly by the locking device.

11. A depilating device as claimed in claim 1, wherein the second housing includes at least one locking element, and the gear assembly further comprises a gear housing having at least one coupling element, wherein the at least one coupling element mates with the at least one locking element.

12. A depilating device as claimed in claim 11, wherein the second housing comprises at least one actuating element for actuating the at least one locking element.

13. A depilating device as claimed in claim 12, further comprising a spring, wherein the at least one actuating element is movable in opposition to the force of the spring transversely to an axis of rotation of the rotary cylinder.

14. A depilating device as claim in claim 12, wherein each of the at least one actuating element and the at least one locking element are formed as parts of a same component part.

15. A depilating device as claimed in claim 12, wherein the second housing comprises at least a second actuating element and the at least one and the at least second actuating elements are arranged on opposed longitudinal sides of the second housing.

16. A depilating device as claimed in claim 1, wherein the second housing is further detachably coupled to the first housing.

17. A depilating device as claimed in claim 1, wherein the vibration absorbing elements are made of rubber.

* * * * *